US007471925B2

(12) United States Patent
Shida et al.

(10) Patent No.: US 7,471,925 B2
(45) Date of Patent: Dec. 30, 2008

(54) SHEET PROCESSING APPARATUS AND IMAGE FORMING SYSTEM

(75) Inventors: Toshio Shida, Higashiyamato (JP); Hirofumi Kayahara, Hachioji (JP); Masashi Kougami, Saitama (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 11/714,759

(22) Filed: Mar. 7, 2007

(65) Prior Publication Data

US 2007/0264067 A1 Nov. 15, 2007

(30) Foreign Application Priority Data

Apr. 13, 2006 (JP) ..... 2006-110555

(51) Int. Cl.
*G03G 15/00* (2006.01)

(52) U.S. Cl. ..... 399/406

(58) Field of Classification Search ..... 347/102; 399/341, 390, 406, 407
See application file for complete search history.

(56) References Cited

U.S. PATENT DOCUMENTS

2005/0286946 A1* 12/2005 Kougami et al. ..... 399/390

FOREIGN PATENT DOCUMENTS

| | | |
|---|---|---|
| JP | 60-052459 | 3/1985 |
| JP | 04-058548 | 2/1992 |
| JP | 04-044248 | 4/1992 |
| JP | 04-338060 | 11/1992 |
| JP | 4-338060 | 11/1992 |
| JP | 5-309971 | 11/1993 |
| JP | 9-110269 | 4/1997 |
| JP | 2000-219389 | 8/2000 |
| JP | 2000-247526 | 9/2000 |
| JP | 2006-154609 A * | 6/2006 |

OTHER PUBLICATIONS

English translation of Office Action issued Apr. 8, 2008, in Japanese Patent Application No. 2006-110555.

* cited by examiner

*Primary Examiner*—David M Gray
*Assistant Examiner*—Ryan Gleitz
(74) *Attorney, Agent, or Firm*—Finnegan, Henderson, Farabow, Garrett & Dunner, L.L.P.

(57) ABSTRACT

A sheet processing apparatus which flattens a curled sheet includes: a water content control unit which controls a water content of a sheet to flatten the curled sheet; a decurling section which is provided downstream the water content control unit with respect to a conveyance direction of the sheet, and the decurling section bends the curled sheet to be flat by a bending force; and a conveyance route changing section which changes a conveyance route of the sheet to direct to the water content control unit or not.

14 Claims, 5 Drawing Sheets

SHEET PROCESSING APPARATUS AND IMAGE FORMING SYSTEM

This application is based on Japanese Patent Application No. JP2006-110555 filed on Apr. 13, 2006, with the Japanese Patent Office, the entire content of which is hereby incorporated by reference.

TECHNICAL FIELD

The present invention relates to a sheet processing apparatus which flattens a curled sheet and an image forming system in which the same apparatus is provided.

BACKGROUND OF THE INVENTION

As is well known, image formation conducted by an electro-photographic process incorporates the process in which toner image is formed via electrostatic charge, exposure and development, the formed toner image is transferred onto a recording sheet and the toner image transferred onto the sheet is fixed.

In the fixing of this process, when toner is melted by heat and pressure to fix the image on the sheet, water evaporates from the sheet due to the heat. Further, after the fixing, the sheet is open to the outside air, and thereby absorbs water from the outside air.

Since such evaporation and absorbance of water occur at a different rate between the front and reverse surfaces of the sheet, resulting in waving or curling on the sheet, which of course is a major problem.

The waved or curled sheets cause troubles during conveyance, subsequent image processing and stacking, in the sheet processing apparatus combined to the image forming apparatus. Further, bundled sheets formed by a filing process increase the thickness due to this deformation, which results in disturbance during binding and storage. Accordingly, technologies which can decurl these sheets have been developed.

That is, in Unexamined Japanese Patent Application Publication 4-338,060 and Unexamined Japanese Patent Application Publication 5-309,971, technology is proposed in which a mechanical bending force is given to the sheet in the conveyance route, to decurl the sheet. The former further proposes the technology in which the amount of decurl can be selected, based on the type of sheet and density of the image fixed on the sheet.

Even if the decurling amount is selected to use based on the type of recording sheet, since there are various types of the sheets, it is to be understood that when only physical bending force is used, sometimes the sheet can not be decurled.

That is, relatively thick sheets are decurled by strong force, but thin sheets can not be decurled when only physical bending force is used. Specifically, bond paper for printing work can not be decurled when only physical bending force is used.

SUMMARY OF THE INVENTION

According to one embodiment of the present invention, a sheet processing apparatus which flattens a curled sheet. The apparatus includes a water content control unit which controls a water content of a sheet; a decurling section which is provided downstream the water content control unit with respect to a conveyance direction of the sheet, and the decurling section bends the curled sheet to be flat by a bending force; and a conveyance route changing section which changes a conveyance route of the sheet to direct to the water content control unit or to the decurling section.

In the present invention, after water is applied to the both surfaces of the sheet to reduce the elasticity of the fibers which form the sheet, the bending force is applied to the sheet to be flattened by the decurling section, and even thin sheets can be properly flattened, whereby problems during conveyance, image processing and stacking are resolved.

BRIEF DESCRIPTIONS OF THE DRAWINGS

DESCRIPTION OF THE PREFERRED EMBODIMENT

Figure 1:
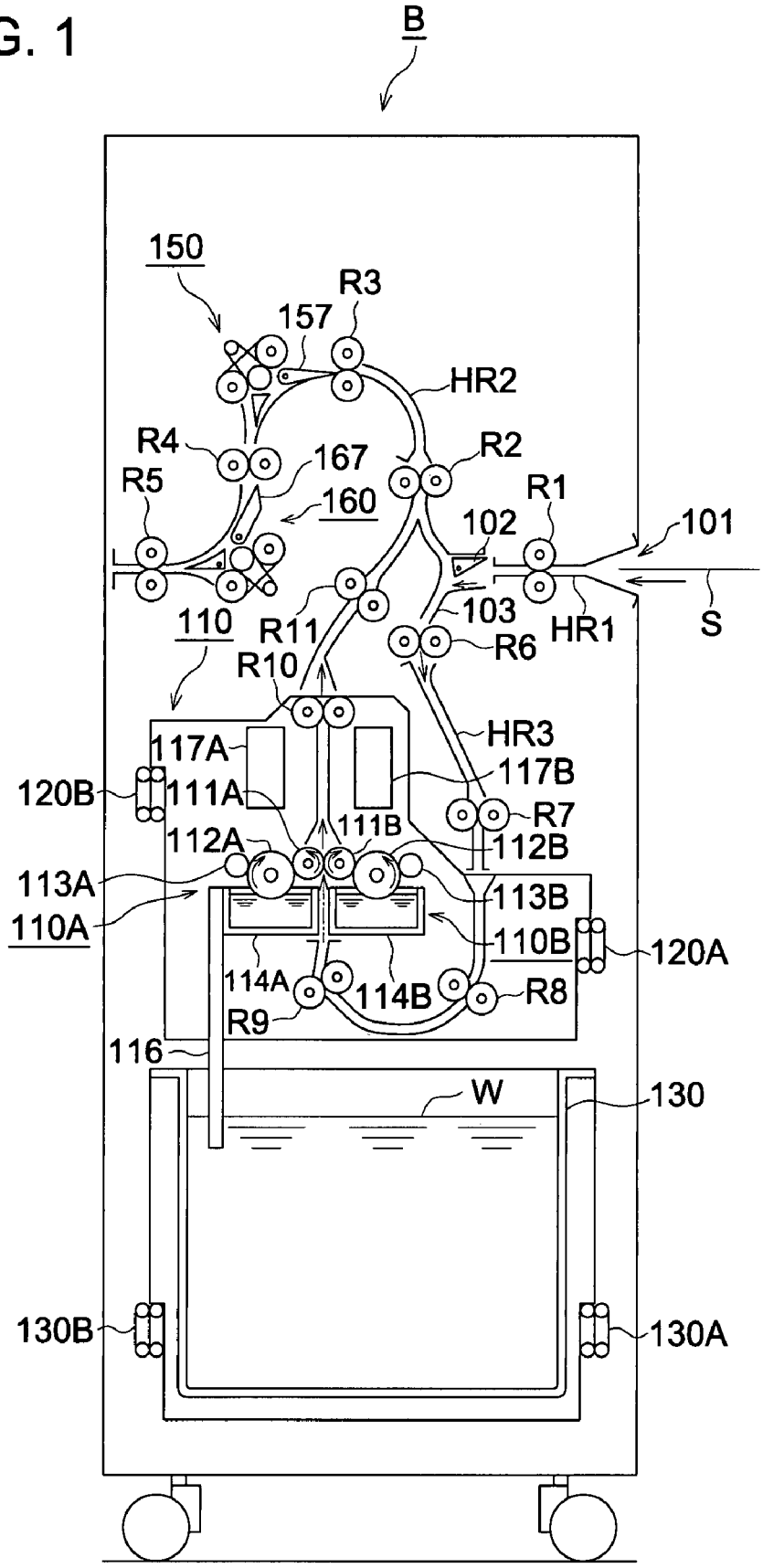
FIG. 1 is a sectional view of a sheet processing apparatus B in an embodiment of the present invention.

The present invention will now be detailed, while referring to the drawings, which however is not limited to the present embodiment.

FIG. 1 is a sectional view of the sheet processing apparatus in the embodiment of the present invention.

Sheet S carrying the image which was formed by an image forming apparatus (which is to be detailed later) is introduced to route HR1 from entrance 101 of sheet processing apparatus B, after sheet S is conveyed through route HR2 or HR3 to be processed, sheet S is discharged from sheet processing apparatus B.

In both a non-decurling mode in which sheet S is not reformed in sheet processing apparatus B and a first decurling mode in which sheet S is mechanically flattened but the water content is not controlled, sheet S is conveyed through routes HR1 and HR2.

On the other hand, in both a water content control mode in which only the water content is controlled and a second decurling mode in which sheet S is mechanically flattened and the water content is controlled, sheet S is conveyed through routes HR1 and HR3 and a portion of route HR2. Route HR2 or HR3 is selected by switching gate 102.

Figure 3:
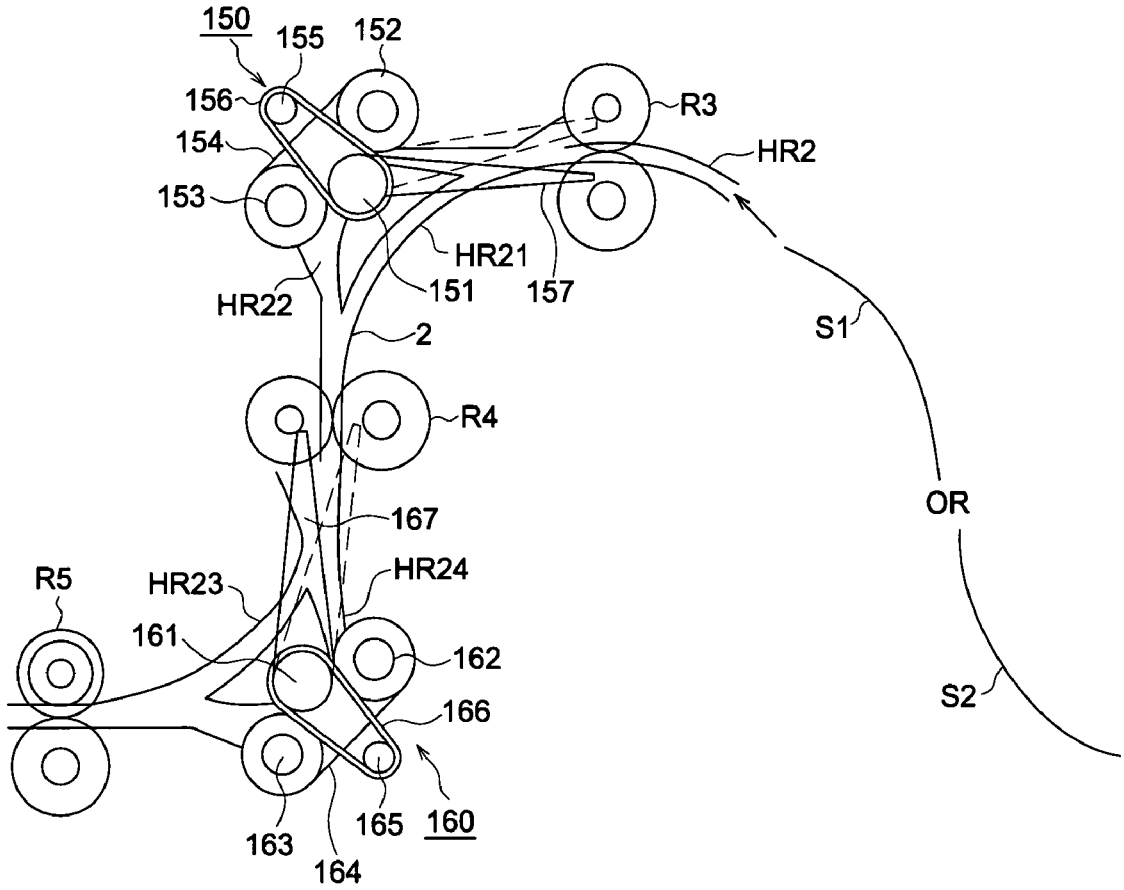
FIG. 3 is an enlarged sectional view of decurling sections 150 and 160.

Mechanical decurling sections 150 and 160 are provided on route HR2. Mechanical decurling section 150 flattens concavely curled sheet S2, and mechanical decurling section 160 flattens convexly curled sheet S1. "Convex curl" means that the surface of the sheet is convex upward, being sheet S1, while "concave curl" means that the surface of the sheet is convex downward, being sheet S2, which are illustrated in FIG. 3.

Water content control unit 110 is provided on route HR3. Water content control unit 110 can be withdrawn by an operator from sheet processing apparatus B, being guided by rails 120A and 120B.

In route HR1, sheet S is conveyed by paired rollers R1, while in route HR2, sheet S is conveyed by paired rollers R2-R5. In route HR3, sheet S is conveyed by paired rollers R6-R11.

Tank unit 130, provided under water content control unit 110 to supply water to water content control unit 110, can be withdrawn from sheet processing apparatus B, being guided by rails 130A and 130B.

Figure 2:
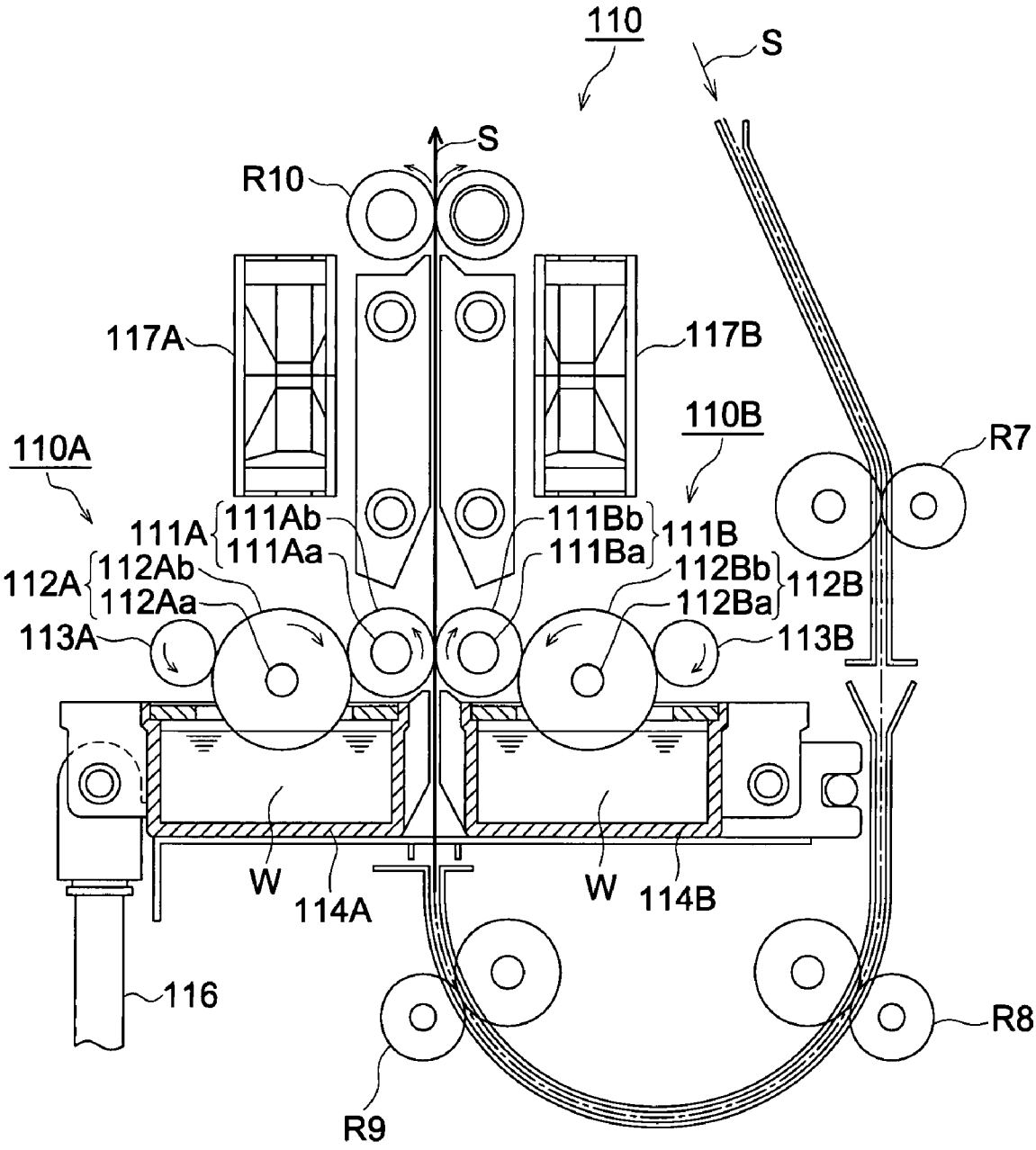
FIG. 2 is an enlarged sectional view of water content control unit 110.

FIG. 2 shows an enlarged sectional view of water content control unit 110.

Sheet S is vertically conveyed from route HR1 (shown in FIG. 1) to route U-shaped route HR3 (shown in FIG. 2), and then turns upward at a U-shaped section. Water content control unit 110 is mounted to sandwich a portion of route HR3 through which sheet S is conveyed upward.

Water content control unit 110 is formed of paired water content control sections, which are left side water content control section 110A and right side water content control section 110B. Left side water content control section 110A is structured of moisturizing roller 111A, water supplying roller 112A and water tank 114A, while right side water content control section 110B is structured of moisturizing roller 111B, water supplying roller 112B and water tank 114B. Moisturizing rollers 111A and 111B are in contact with each other, and rotate as shown by arrows to convey sheet S and to supply water to sheet S.

Water supplying roller 112A is in contact with moisturizing roller 111A, while water supplying roller 112B is in contact with moisturizing roller 111B. Water supplying roller 112A is partially submerged in water W of water tank 114A, and water supplying roller 112B is partially submerged in water W of water tank 114B.

Control member 113A squeezes water supplying roller 112A to regulate the water content of water supplying roller 112A, while control member 113B squeezes water supplying roller 112B to regulate the water content of water supplying roller 112B.

Moisturizing rollers 111A and 111B, as well as water supplying rollers 112A and 112B are formed of single layered or double layered elastic members, such as non-foamed solid rubber and foamed rubber, or formed of double layered rubbers on which a textile is wrapped. Moisturizing roller 111A is structured of metallic core 111Aa and rubber layer 111Ab layered on the same, while moisturizing roller 111B is structured of metallic core 111Ba and rubber layer 111Bb layered on the same. Water supplying roller 112A is structured of metallic core 112Aa and rubber layer 112Ab formed on the same, while water supplying roller 112B is structured of metallic core 112Ba and rubber layer 112Bb formed on the same.

Control members 113A and 113B are round bars which rotate or do not rotate. Flat blades may also be used for control members 113A and 113B.

Water W stored in tank unit 130 is pumped up to water tanks 114A and 114B by a pump which is not illustrated, and any overflow in each tank returns to tank unit 130 through overflow tube 116, whereby water level in water tanks 114A and 114B are secured in the same. In addition, water tanks 114A and 114B are connected to each other, and water in each tank is controlled to remain at the same level.

During the water supplying process, moisturizing rollers 111A and 111B, as well as water supplying rollers 112A and 112B rotate as shown by arrows to supply water to each side of sheet S.

Moisturizing roller 111A and water supplying roller 112A are symmetrically arranged with moisturizing roller 111B and water supplying roller 112B with respect to route HR3 as shown in FIG. 1. Therefore, the form and the length of the water supplying path from water tank 114A to moisturizing roller 111A is the same as those of a water supplying path from water tank 114B to moisturizing roller 111B.

Accordingly, an equal amount of water is supplied to both sides of sheet S. Further, since sheet S is moisturized in vertical route HR3, an equal amount of water is supplied onto sheet S in the direction of the thickness of sheet S, which preferably maintains the flatness of sheet S.

Fans 117A and 117B blow dry air onto both surfaces of sheet S, which allow extra water in sheet S to evaporate just after the water supply so that parts mounted in the route, such as rollers, are prevented from covered with water.

FIG. 3 is an enlarged sectional view of decurling sections 150 and 160.

Decurling section 150 is structured of small diameter roller 151 (having a radius of 7 mm, for example), paired belt driven rollers 152 and 153, and belt 154 entraining about belt driven rollers 152 and 153. Spring 156 is entrained about shaft 155 and small diameter roller 151, and allows small diameter roller 151 to press against belt 154.

Changeover gate 157 switches the conveyance routes of sheet S. When changeover gate 157 exists at the dotted position in FIG. 3, route HR21 is selected through which sheet S can not enter decurling section 150, while when changeover gate 157 exists at the solid-line position, route HR22 is selected through which sheet S enters decurling section 150.

Since route HR21 has a large curvature radius, for example 60 mm, as shown in the figure, when sheet S passes through route HR21, no decurling operation is conducted. On the other hand, when sheet S passes through route HR 22 formed of small diameter roller 151 and belt 154, sheet S is decurled by bending force generated by small diameter roller 151 and belt 154. That is, a concavely curled sheet S2 is returned to be a flat sheet state.

Next, decurling section 160 is structured of small diameter roller 161 (having, for example, a radius of 7 mm), paired belt driven rollers 162 and 163, and belt 164 entraining about belt driven rollers 162 and 163. Coiled spring 166 is entrained about shaft 165 and small diameter roller 161, and allows small diameter roller 161 to press against belt 164.

Changeover gate 167 switches the conveyance routes of sheet S. When changeover gate 167 exists as at the dotted-line position in FIG. 3, route HR23 is selected through which sheet S does not enter decurling section 160, while when changeover gate 167 exists as at the solid-line position, route HR24 is selected through which sheet S enters decurling section 160.

Since route HR23 has a large curvature radius for example, 60 mm, as shown in the figure, when sheet S passes through route HR23, no decurling is conducted. On the other hand, when sheet S passes through route HR 24, sheet S is decurled by bending force generated by small diameter roller 161 and belt 164. That is, convexly curled sheet S is returned to its original flat sheet state.

Using sheet processing apparatus B, the operator can select an operation mode from among: a non-decurling mode which does not reform sheet S, a water content control mode which moisturizes sheet S, a first decurling mode which flattens sheet S using a bending force, but without moisturizing sheet S, and a second decurling mode which flattens sheet S using a bending force after moisturizing sheet S.

In the non-decurling mode, route HR2 is selected by changeover gate 102 as shown in FIG. 1, and routes HR 21 and HR23 shown in FIG. 2 are selected by changeover gates 157 and 167, respectively, through which sheet S is conveyed.

In the water content control mode, route HR 3 is selected by changeover gate 102 in FIG. 1, and routes HR 21 and HR23 shown in FIG. 2 are selected by changeover gates 157 and 167, respectively. After sheet S passes through routes HR1 and HR3 in FIG. 1, sheet S is moisturized by water supplying device 110, then sheet S enters route HR2 between paired rollers R2, and further passes through routes HR21 and HR23 to be ejected out of sheet processing apparatus B.

The first decurling mode, in which sheet S is mechanically decurled without water, includes decurling mode A which flattens the concavely curled sheet, and decurling mode B which flattens the convexly curled sheet.

In decurling mode A, after route HR2 is selected by changeover gate 102 shown in FIG. 1, route HR22 is selected by changeover gate 157, and route HR23 is selected by changeover gate 167 shown in FIG. 3.

Accordingly, concavely curled sheet S2 passes through the selected routes which are HR2, HR22 and HR23, and is reformed to the original flat sheet state by decurling section 150, after which flattened sheet S is ejected out of sheet processing apparatus B.

In decurling mode B, after route HR2 is selected by changeover gate 102 shown in FIG. 1, route HR21 is selected by changeover gate 157, and route HR24 is selected by changeover gate 167.

Accordingly, convexly curled sheet S1 passes through the selected routes which are HR2, HR21 and HR24, and is returned to its original flat sheet state by decurling section 160, after which flattened sheet S is ejected out of sheet processing apparatus B.

The second decurling mode in which sheet S is mechanically decurled and water content of the sheet is controlled, also includes decurling mode A and decurling mode B.

In decurling mode A, after route HR3 is selected by changeover gate 102 shown in FIG. 1, route HR22 is selected by changeover gate 157, and route HR23 is selected by changeover gate 167 shown in FIG. 3.

Accordingly, concavely curled sheet S2 passes through route HR3, after which it is moisturized by water content control unit 110, and is reformed to be its original flat sheet state by decurling section 150, then flattened sheet S is ejected out of sheet processing apparatus B.

In decurling mode B, after route HR3 is selected by changeover gate 102 shown in FIG. 1, sheet S passes through route HR2 and route HR21 which is selected by changeover gate 157, and further passes through route HR24 which is selected by changeover gate 167 shown in FIG. 3.

Accordingly, convexly curled sheet S1 passes through route HR3, after which it is moisturized by water content control unit 110, and is reformed to be its original flat sheet state by decurling section 160, then flattened sheet S is ejected out of sheet processing apparatus B.

Table 1 shows the effects of reformation of the various types of sheets.

TABLE 1

| | Sheet | | Amount of curl (average value at 4 corners of a single side copy) [mm] | | |
|---|---|---|---|---|---|
| | | | | After decurling operation | |
| Symbol | Basis weight [g/m$^2$] | Types of sheet | Before decurling operation | When water content is not controlled [water content: 2%] | When water content is controlled [water content: 6%] |
| A | 64 | J paper (sheet for plain paper copier) | 5 | 3 | 3 |
| B | | Kinmari-V (bond paper) | 12 | 11 | 4 |
| C | 81.4 | Kinmari-V (bond paper) | 14 | 10 | 3 |
| D | 128 | Kinmari-V (bond paper) | 16 | 4 | 4 |

TABLE 1-continued

| | Sheet | | Amount of curl (average value at 4 corners of a single side copy) [mm] | | |
|---|---|---|---|---|---|
| | | | | After decurling operation | |
| Symbol | Basis weight [g/m$^2$] | Types of sheet | Before decurling operation | When water content is not controlled [water content: 2%] | When water content is controlled [water content: 6%] |
| E | | Connie Kent (PPC) | 10 | 2 | 3 |
| F | 209 | Connie Kent (PPC)) | 9 | −2 | 2 |
| G | 262 | Connie Kent (PPC) | 12 | −3 | 3 |

J-paper: KONICAMINOLTA HOLDINGS, INC.
Kinmari-V: HOKUETSU PAPER MILLS, LTD.

Figure 4:
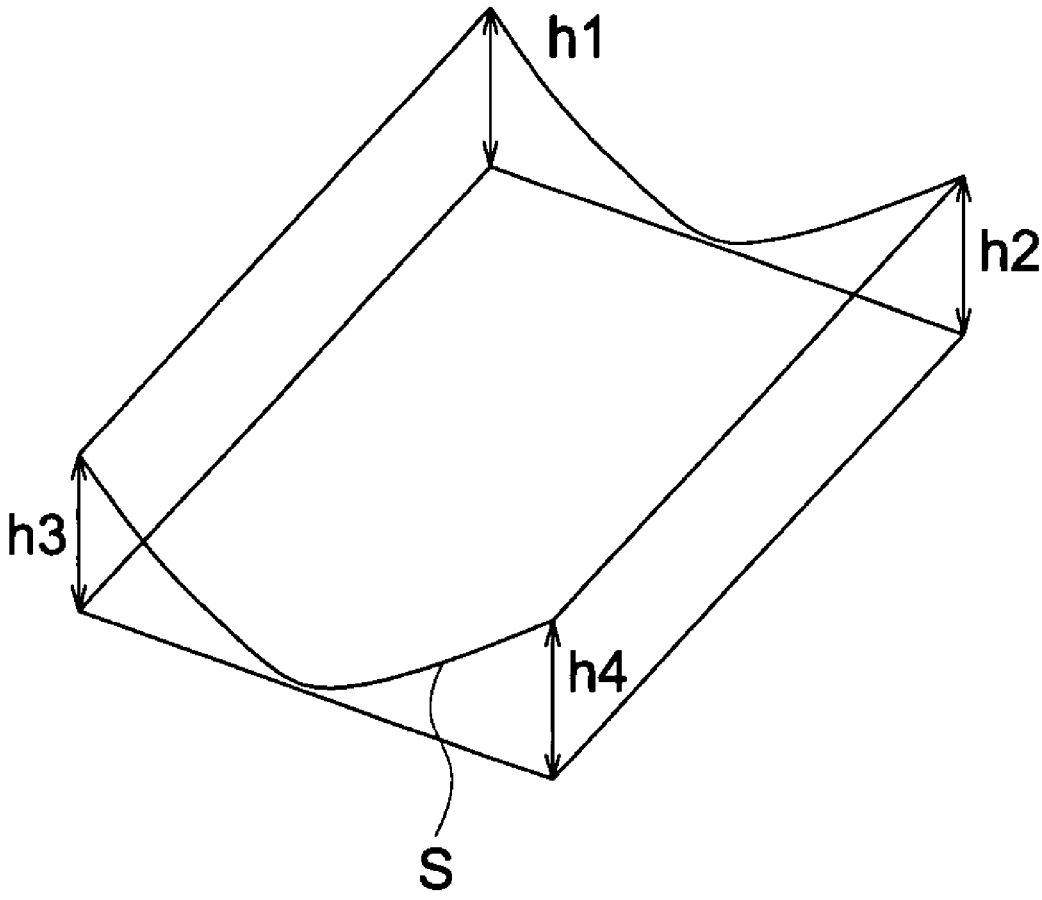
FIG. 4 is a drawing for the explanation of the amount of curl.

In Table 1, PPC paper represents paper for the plain paper copier, while bond paper represents paper for printing. The amount of curl represents the average of differences h1 to h4 measured between the height of center and the height of four corners of A4 sized sheet S, as shown in FIG. 4.

As shown by Table 1, curled sheets A and D-G are effectively flattened by the bending force of the mechanical decurling section without a water supplying process, while curled sheets B and C are not. However, curled sheets B and C are effectively flattened by the bending force of the decurling section after the water supplying process.

Accordingly, based on the present embodiment, when the bending force is applied to a curled sheet by the mechanical decurling section after water is supplied, the various types of sheets are effectively flattened, though they are conventionally very difficult to be flattened by only the mechanical bending force.

In addition to the above flattening effects, the present embodiment can also be used like below.

That is, due to the water supplying process, some types of sheet may be curled or excessively curled. Such phenomena occur on sheets having coating layers, because the material of the sheet is not uniform, in view of the thickness direction.

In such a case, after flat sheet S is curled by water content control unit 110, it can be flattened to its original state by decurling section 150 or 160.

Figure 5:
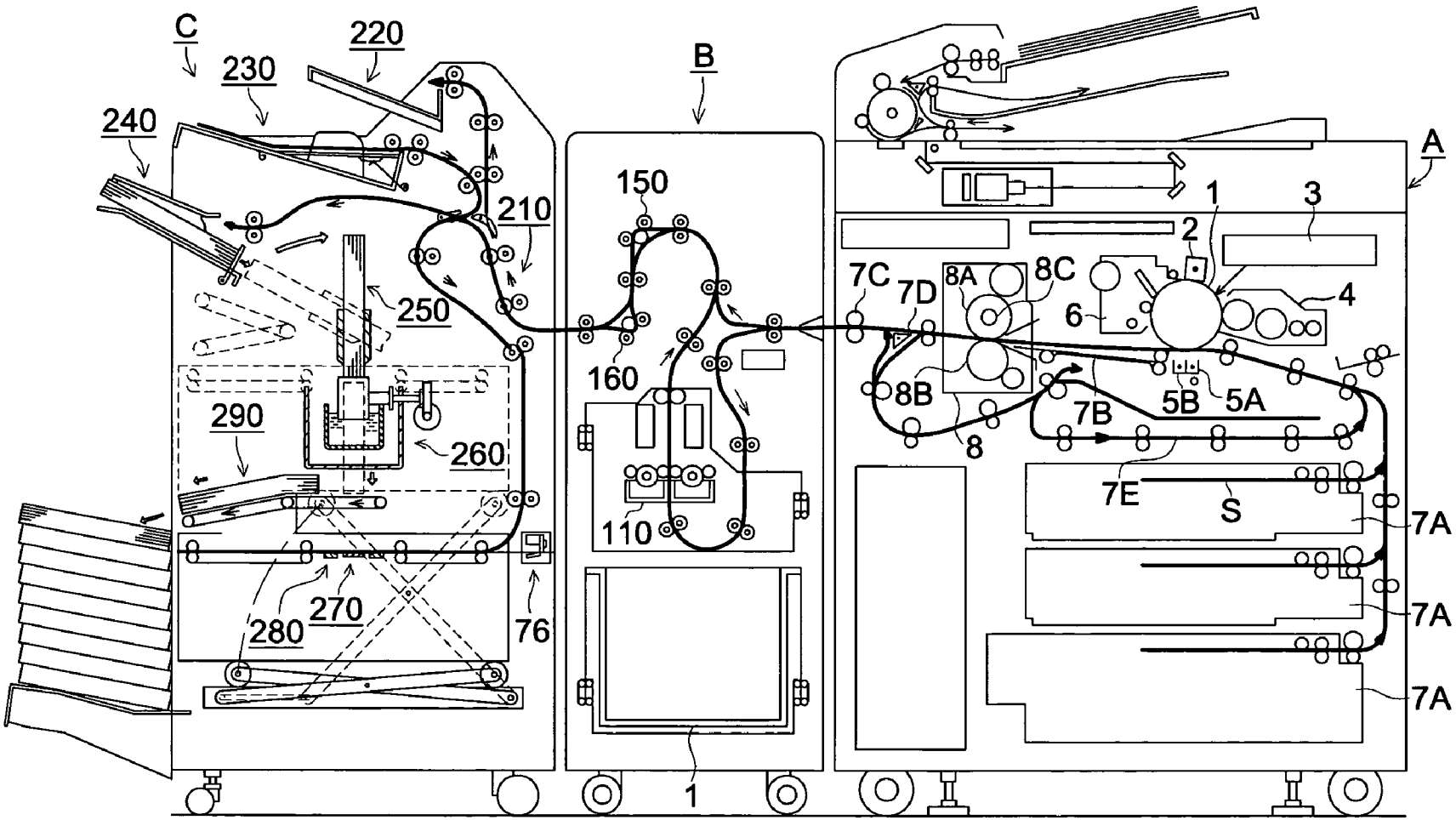
FIG. 5 shows the total structure of an image forming system relating to the embodiment of the present invention.

FIG. 5 shows a total structure of an image forming system, including image forming apparatus A, sheet processing apparatus B and book binding apparatus C (which is a sheet post-processing apparatus), relating to the embodiment of the present invention.

Image forming apparatus A incorporates an image forming section which includes: charging section 2, image exposure section 3 (which is a writing section), developing section 4, transfer section 5A, discharging section 5B and cleaning section 6, all of which are mounted around image carrier 1. In the image forming section, after the surface of image carrier 1 is evenly charged by charging device 2, which is scanned by laser beam generated by image exposure device 3 based on the image data which are read from the document, whereby latent images are formed on the surface of image carrier 1. The latent images are developed by developing section 4, and form the reversal toner image on the surface of image carrier 1.

Sheet S, which is supplied from sheet accommodating section 7, is conveyed to a transfer position. At the transfer position, the above toner images are transferred by transfer section 5A onto sheet S. After electrical charges on the reverse side of Sheet S are neutralized by discharging section 5B, sheet S carrying the toner images separates from image carrier 1, and is conveyed to conveyance section 7B, further, sheet S is heat-fixed by fixing section 8, and then ejected by paired ejecting rollers 7C into sheet processing apparatus B.

In addition, fixing section 8 includes heat roller 8A, pressure applying roller 8B to press against heat roller 8A, and heater 8C. The unfixed toner images are heated by heat roller 8A, which is heated by heater 8C, whereby deposited toner for forming the toner images is melted and fixed on sheet S.

In the case of the double-sided image formation on sheet S, which has been heat-fixed by fixing section 8, sheet S is branched from an ordinal ejecting route by route changeover plate 7D, sheet S is flipped over in reverse conveyance section 7E, and again conveyed to the image forming section. After images are formed on the reverse side of sheet S, sheet S is re-conveyed to fixing section 8, and ejected by paired ejecting rollers 7C from image forming apparatus A into sheet processing apparatus B.

Concerning image carrier 1, after the images are processed, any remaining toner on its surface is removed by cleaning section 6, and image carrier 1 stands-by for the next image formation.

In sheet processing apparatus B, sheet S is controlled based on the selected mode, such as the non-decurling mode which does not reform sheet S, the water content control mode which moisturizes sheet S, the first decurling mode which flattens sheet S using bending force without supplying water to sheet S, and the second decurling mode which flattens sheet S using bending force after sheet S is moisturized.

The operator selects any of these modes using an operation section (which is not illustrated) of image forming apparatus A, or instructions sent via a network from an outer apparatus can be used to select the mode.

Book binding apparatus C, as the sheet post-processing apparatus, is structured of sheet conveyance section 210, sheet ejecting section 220, cover supplying section 230, printed sheets accommodating section 240, printed sheets conveyance section 250, pasting section 260, cover attaching section 270, cover folding section 280, and book ejecting section 290, all of which are vertically oriented in book binding apparatus C.

When sheets S are to be ejected without being bound, the route directing to printed sheets accommodating section 240 is closed, and the route directing to sheet ejecting section 220 is opened.

When printed sheets S are to be bound, sheets S are sequentially stacked on a predetermined position of printed sheets accommodating section 240, whereby a stack of the printed sheets S is formed, which includes predetermined number of pages. The stack of the printed sheets S on sheets accommodating section 240 is conveyed to stacked sheets supporting section 250, and section 250 rotates and stands vertically, then glue is applied onto the edge of the stacked sheets by pasting section 260.

Next, a cover sheet is supplied from cover supplying section 230 to be attached onto the stack by cover attaching section 270, and the cover is folded by cover folding section 280 to become a book.

The book is then ejected by book ejecting section 290 from book binding apparatus C.

Additionally, book binding apparatus C is further detailed in JPA 2003-209,869.

What is claimed is:

1. A sheet processing apparatus which flattens a curled sheet carrying images on both surfaces, comprising:

a water content control unit configured to control a water content of the curled sheet carrying images on both surfaces, so as to moisturize the curled sheet carrying images on both surfaces;

a decurling section which is provided downstream from the water content control unit with respect to a conveyance direction of the curled sheet carrying images on both surfaces, the decurling section being configured to bend the curled sheet carrying images on both surfaces to be flat by a bending force; and a conveyance route changing section provided upstream from the water content control unit with respect to the conveyance direction of the curled sheet and configured to control whether a conveyance route of the curled sheet conveys the curled sheet to the water content control unit.

2. The sheet processing apparatus of claim 1, wherein the decurling section comprises plural decurling members, one of which is configured to flatten a concavely curled sheet, while another is configured to flatten a convexly curled sheet; and wherein the conveyance route changing section is configured to further change the conveyance route, based on whether the curled sheet is concavely curled or convexly curled.

3. The sheet processing apparatus of claim 2, wherein a mode of the conveyance route of the curled sheet is selected among:

a non-processing mode in which the sheet is not conveyed to the water content control unit nor the decurling section;

a water content control mode in which after the sheet is conveyed to the water content control unit to be moisturized, the sheet does not pass through the decurling section;

a first decurling mode in which the sheet does not pass through the water content control unit, but is conveyed to the decurling section to be flattened; and a second decurling mode in which after the sheet passes through the water content control unit to be moisturized, the sheet is conveyed to the decurling section to be flattened.

4. The sheet processing apparatus of claim 1, wherein the water content control unit comprises paired moisturizing sections which supply water to both surfaces of the sheet as the sheet moves vertically through the water content control unit.

5. The sheet processing apparatus of claim 4, wherein the water content control unit further comprises plural remaining water evaporating sections which are provided downstream the paired moisturizing sections with respect to the conveyance direction, and which are configured to blow air to the both surfaces of the sheet.

6. The sheet processing apparatus of claim 2, wherein each decurling member comprises a belt and a pressure applying roller, and applies the bending force to the curled sheet when the curled sheet is pinched between the belt and the pressure applying roller.

7. An image forming system comprising:

an image forming apparatus having an image forming section and a fixing section which fixes a formed image by an application of heat, a sheet processing apparatus of claim 1, and a sheet post-processing apparatus; wherein said sheet processing apparatus is positioned between the image forming apparatus and the sheet post-processing apparatus.

8. A sheet processing apparatus which flattens a curled sheet, comprising:

a water content control unit configured to control a water content of the curled sheet, so as to moisturize the curled sheet;

a decurling section which is provided downstream from the water content control unit with respect to a conveyance direction of the curled sheet, the decurling section being configured to bend the curled sheet to be flat by a bending force;

a first conveyance route changing section configured to control whether a conveyance route of the curled sheet directs the curled sheet to the water content control unit; and a second conveyance route changing section configured to control whether the conveyance route directs the curled sheet to the decurling section.

9. The sheet processing apparatus of claim 8, wherein the decurling section comprises plural decurling members, one of which is configured to flatten a concavely curled sheet, while another is configured to flatten a convexly curled sheet; and wherein the second conveyance route changing section is configured to change the conveyance route, based on the whether the curled sheet is concavely curled or convexly curled.

10. The sheet processing apparatus of claim 9, wherein a mode of the conveyance route of the curled sheet is selected among:

a non-processing mode in which the sheet is not conveyed to the water content control unit or the decurling section;

a water content control mode in which after the sheet is conveyed to the water content control unit to be moisturized, the sheet does not pass through the decurling section;

a first decurling mode in which the sheet does not pass through the water content control unit, but is conveyed to the decurling section to be flattened; and a second decurling mode in which after the sheet passes through the water content control unit to be moisturized, the sheet is conveyed to the decurling section to be flattened.

11. The sheet processing apparatus of claim 8, wherein the water content control unit comprises paired moisturizing sections which supply water to both surfaces of the sheet as the sheet moves vertically through the water content control unit.

12. The sheet processing apparatus of claim 11, wherein the water content control unit further comprises plural remaining water evaporating sections which are provided downstream the paired moisturizing sections with respect to the conveyance direction, and which are configured to blow air to the both surfaces of the sheet.

13. The sheet processing apparatus of claim 9, wherein each decurling member comprises a belt and a pressure applying roller, and applies the bending force to the curled sheet when the curled sheet is pinched between the belt and the pressure applying roller.

14. An image forming system comprising:

an image forming apparatus having an image forming section and a fixing section which fixes a formed image by an application of heat, a sheet processing apparatus of claim 8, and a sheet post-processing apparatus; wherein said sheet processing apparatus is positioned between the image forming apparatus and the sheet post-processing apparatus.

* * * * *